US008689888B2

(12) United States Patent
Varghese et al.

(10) Patent No.: US 8,689,888 B2
(45) Date of Patent: Apr. 8, 2014

(54) METHOD AND APPARATUS FOR POSITIONING A WELLHEAD MEMBER INCLUDING AN OVERPULL INDICATOR

(75) Inventors: Sibu Varghese, Houston, TX (US); Ryan Herbel, Houston, TX (US); Dien Nguyen, Houston, TX (US); Javier Garcia, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 600 days.

(21) Appl. No.: 12/913,553

(22) Filed: Oct. 27, 2010

(65) Prior Publication Data

US 2012/0103597 A1 May 3, 2012

(51) Int. Cl.
*E21B 33/03* (2006.01)

(52) U.S. Cl.
USPC ..... 166/379; 166/85.5; 166/75.14; 166/241.6

(58) Field of Classification Search
USPC ..... 166/379, 85.5, 75.14, 241.6, 382.3, 166/242.6
See application file for complete search history.

(56) References Cited

U.S. PATENT DOCUMENTS

| | | | | |
|---|---|---|---|---|
| 3,472,530 | A * | 10/1969 | Fowler | 285/3 |
| 4,520,869 | A | 6/1985 | Svenson | |
| 4,591,780 | A * | 5/1986 | Yamada et al. | 323/313 |
| 4,875,524 | A | 10/1989 | Bradley et al. | |
| 5,066,048 | A * | 11/1991 | Farrell | 285/18 |
| 5,238,062 | A | 8/1993 | Reinholdt | |
| 5,549,161 | A | 8/1996 | Gomez et al. | |
| 5,575,333 | A | 11/1996 | Lirette et al. | |
| 5,908,072 | A | 6/1999 | Hawkins | |
| 6,257,339 | B1 | 7/2001 | Haugen et al. | |
| 6,435,275 | B1 | 8/2002 | Kirk et al. | |
| 6,453,998 | B1 | 9/2002 | Reeve | |
| 6,453,999 | B1 | 9/2002 | Reinholdt | |
| 6,457,519 | B1 | 10/2002 | Buytaert | |
| 6,585,052 | B2 | 7/2003 | Angman et al. | |
| 6,637,511 | B2 | 10/2003 | Linaker | |
| 6,679,325 | B2 | 1/2004 | Buytaert | |
| 6,725,939 | B2 | 4/2004 | Richard | |
| 6,871,706 | B2 | 3/2005 | Hennessey | |
| 7,040,407 | B2 | 5/2006 | Jennings et al. | |

(Continued)

FOREIGN PATENT DOCUMENTS

| | | |
|---|---|---|
| GB | 2475408 A | 5/2011 |
| WO | 2009035917 A2 | 3/2009 |

OTHER PUBLICATIONS

U.S. Appl. No. 12/415,198, filed Mar. 31, 2009 "Wellhead System Having Resilient Device to Actuate a Load Member and Enable an Over-Pull Test of the Load Member".

(Continued)

*Primary Examiner* — David Andrews
*Assistant Examiner* — Richard Alker
(74) *Attorney, Agent, or Firm* — Bracewell & Giuliani LLP

(57) ABSTRACT

An outer wellhead member has a bore with a first profile portion and an annular recess. A tubular inner wellhead member with a centralizer/overpull ring is lowered into the outer wellhead member. The centralizer/overpull ring is biased to expand outward to engage the bore of the outer wellhead member to center the inner wellhead member within the bore as the inner wellhead member is lowered through the bore. The recess of the outer wellhead member is adapted to receive the centralizer/overpull ring and oppose axial movement of the centralizer/overpull ring to enable an upward test pull of the inner wellhead member.

19 Claims, 6 Drawing Sheets

(56) References Cited

U.S. PATENT DOCUMENTS

| | | | | |
|---|---|---|---|---|
| 7,071,697 | B2 | 7/2006 | Rioufol et al. | |
| 7,150,323 | B2 | 12/2006 | Ford | |
| 7,219,738 | B2 | 5/2007 | Reimert | |
| 7,380,607 | B2 * | 6/2008 | Thomas | 166/348 |
| 8,453,728 | B2 * | 6/2013 | Heburn | 166/208 |
| 2010/0243238 | A1 * | 9/2010 | Gette et al. | 166/208 |
| 2011/0114330 | A1 * | 5/2011 | Gette | 166/368 |

OTHER PUBLICATIONS

U.S. Appl. No. 12/620,373, filed Nov. 17, 2009 "Combination Well Pipe Centralizer and Overpull Indicator".

GB Search Report dated Nov. 21, 2011 from corresponding Application No. GB1118044.5.

* cited by examiner

METHOD AND APPARATUS FOR POSITIONING A WELLHEAD MEMBER INCLUDING AN OVERPULL INDICATOR

FIELD OF THE INVENTION

This technique relates in general to running and setting well pipe hangers in wellbores, and, in particular, a well pipe hanger centralizer and overpull indicator.

BACKGROUND OF THE INVENTION

Centralizers have been in use for a long time. As their name suggests they have been used to center a tubular in a borehole. Centralizers are used on well pipe hangers to centralize the hanger, allowing the hanger to land on the corresponding tag shoulder properly, thereby preventing premature actuation of setting resistance devices, such as hanger load rings. The centralizers prevent the casing from side loading the hanger against the wellhead, which could result in premature actuation of setting resistance devices. The centralizers have been made of metal and non-metallic materials such as thermoplastic polyamides, glass, and mineral filled nylons and polytetra fluoro ethylene, also known as Teflon and injection molded polyurethane. These centralizers were made in hinged segments that could be clamped onto a tubular and in some applications the centralizers were formed right on to or slipped over the rod or tubular. After the hanger is delivered to the proper position, no positive indication is provided to the operator that the hanger has been delivered to the proper position.

A need exists for a technique that ensures that a well pipe hanger is properly centralized and set. The following technique may solve one or more of these problems.

SUMMARY OF THE INVENTION

An embodiment of the wellhead assembly as comprised by the present technique has an outer wellhead member with a bore. The bore has a first profile portion and an annular recess. A tubular inner wellhead member is adapted to be lowered into the bore of the outer wellhead member. A centralizer/overpull ring is positioned on the inner wellhead member. The centralizer/overpull ring has a lower band portion and a plurality of resilient finger members extending upwardly therefrom. The plurality of resilient finger members are each separated from one another by a slot and are biased to expand outward to engage the bore of the outer wellhead member to center the inner wellhead member within the bore as the inner wellhead member is lowered through the bore. The recess of the outer wellhead member is adapted to receive the plurality of resilient finger members and oppose axial movement of the centralizer/overpull ring to enable an upward test pull of the inner wellhead member.

An embodiment of the wellhead assembly as comprised by the present technique has an outer wellhead member that has a bore. The bore has a first profile portion and an annular recess. A tubular inner wellhead member is adapted to be lowered into the bore of the outer wellhead member. A centralizer/overpull ring is positioned on the inner wellhead member. The centralizer/overpull ring has a lower band portion and a plurality of resilient finger members extending upwardly therefrom. The plurality of resilient finger members are each separated from one another by a slot and are biased to expand outward to engage the bore of the outer wellhead member to center the inner wellhead member within the bore as the inner wellhead member is lowered through the bore.

The recess of the outer wellhead member is adapted to receive the plurality of resilient finger members and oppose axial movement of the centralizer/overpull ring to enable an upward test pull of the inner wellhead member. A retainer ring is positioned on the inner wellhead member above the centralizer/overpull ring and is adapted to limit the extent to which the plurality of resilient finger members extend radially outward from the inner wellhead member.

An embodiment of a method for assembling a wellhead assembly as comprised by the present technique includes providing an outer wellhead member that has a bore. The bore has a first profile portion and an annular recess. A tubular inner wellhead member is provided with a resilient retractable and expandable centralizer/overpull ring positioned thereon. The inner wellhead member is lowered into the outer wellhead member with the centralizer/overpull ring in an expanded run-in position. The centralizer/overpull ring is retracted into a recess on the inner wellhead member due to contact of the centralizer/overpull ring with the bore as the inner wellhead member is lowered into the outer wellhead member. When the inner wellhead member has reached a desired position within the outer wellhead member, the centralizer/overpull ring is expanded into the recess of the outer wellhead member.

BRIEF DESCRIPTION OF THE DRAWINGS

So that the manner in which the features and benefits of the technique, as well as others which will become apparent, may be understood in more detail, a more particular description of the technique briefly summarized above may be had by reference to the embodiments thereof which are illustrated in the appended drawings, which form a part of this specification. It is also to be noted, however, that the drawings illustrate only various embodiments of the technique and are therefore not to be considered limiting of the technique's scope as it may include other effective embodiments as well.

DETAILED DESCRIPTION OF THE INVENTION

The present technique now will be described more fully hereinafter with reference to the accompanying drawings in which a preferred embodiment of the technique is shown. This technique may, however, be embodied in many different forms and should not be construed as limited to the embodiment set forth herein; rather, this embodiment is provided so that this disclosure will be thorough and complete, and will fully convey the scope of the technique to those skilled in the art. Like numbers refer to like elements throughout.

Figure 1:
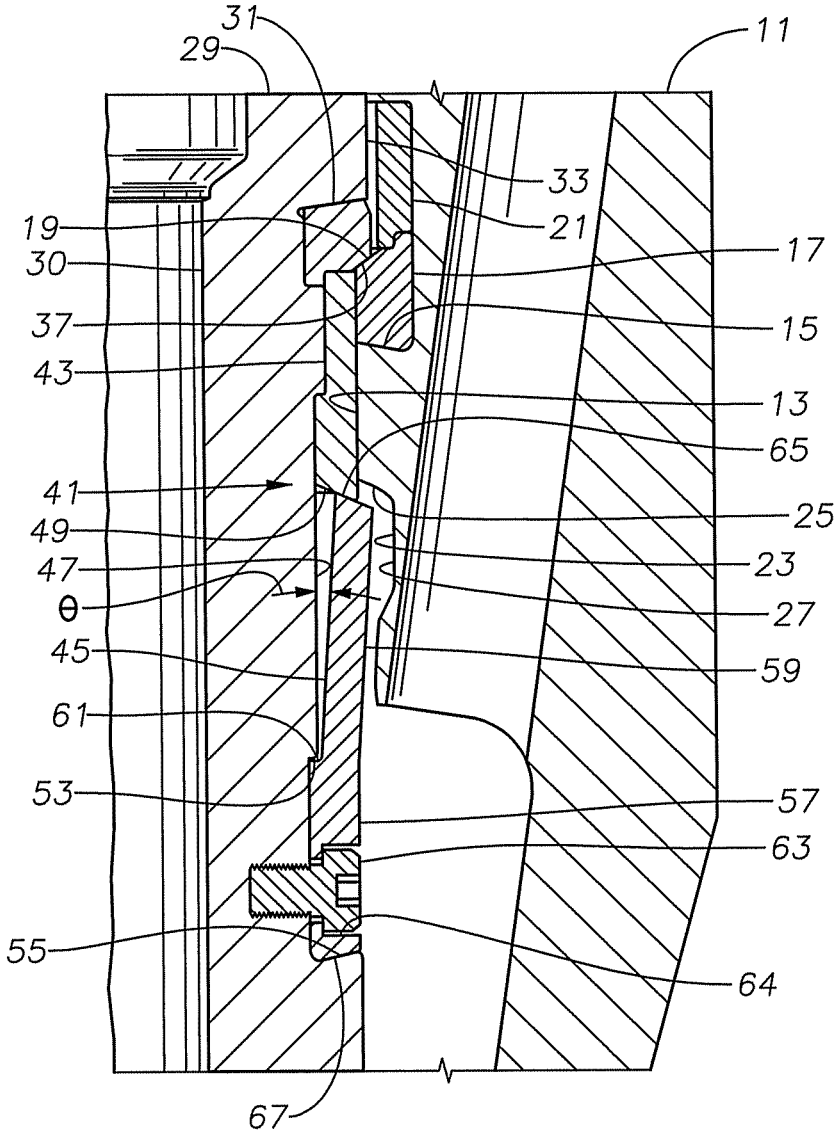
FIG. 1 is an isolated sectional view of an inner wellhead member, including a load ring and a centralizer/overpull assembly constructed in accordance with the present technique, shown in a set position within an outer wellhead member.

Referring to FIG. 1, an embodiment of an outer wellhead member 11 is illustrated. In this embodiment, the outer wellhead member 11 is positioned within a landing sub connected to well pipe positioned below a high pressure wellhead housing. However, the outer wellhead member 11 may be a high pressure housing or other housing having an axial bore 13.

The axial bore 13 of the outer wellhead member 11 has a tag/load shoulder 15 located within it. In this embodiment, the tag/load shoulder 15 is a circular ledge located at a junction between a larger diameter upper portion of the bore 13 and a slightly smaller diameter lower portion of the bore 13. In this embodiment, a load ring 17 is carried by the outer wellhead member 11 and is positioned on the tag/load shoulder 15 of the bore 13. The lower surface of the load ring 17 is substantially geometrically complimentary to tag/load shoulder 15. The upper surface of the load ring 17 is conical and forms a generally upward facing shoulder 19 that inclines relative to an axis of the bore 13. A retainer ring 21 is positioned above and engaged with the load ring 17 to maintain the position of the load ring 17 on the tag/load shoulder 15. The bore 13 also has an annular overpull recess 23 located within it, a select distance below the tag/load shoulder 15. In this embodiment, the overpull recess 23 is formed by a conical, generally downward facing overpull shoulder 25 that declines relative to the axis of the bore 13 and a surface 27 that is generally cylindrical and concentric to the axis of the bore 13 of the outer wellhead member 11 and extends downward from the overpull shoulder 25. In this embodiment, the overpull shoulder 25 declines relative to the axis of the bore 13 of the outer wellhead member 11 at an angle of thirty degrees. In alternate embodiments, the overpull shoulder 25 declines relative to the axis of the bore 13 of the outer wellhead member 11 at an angle between thirty degrees and sixty degrees.

Figure 2:
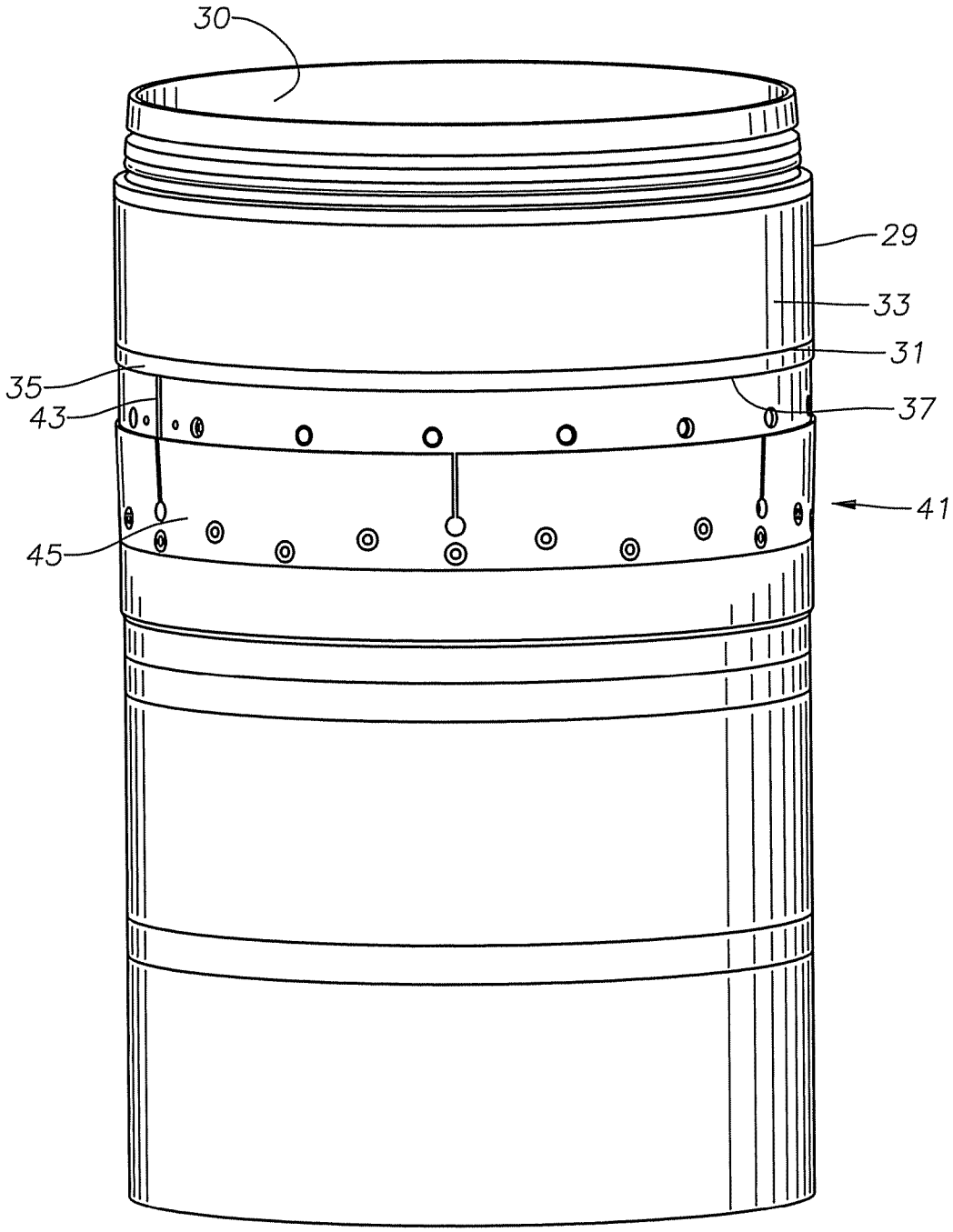
FIG. 2 is an isolated perspective view of the inner wellhead member of FIG. 1, including the load ring and the centralizer/overpull assembly.

An inner wellhead member 29 lands within the outer wellhead member 11 in the illustrated embodiment and has an axial bore 30. For example, the inner wellhead member 29 may be a well pipe hanger, such as a casing hanger. As illustrated in FIGS. 1 and 2, the inner wellhead member 29 has a profile made up of a load shoulder 31. In this embodiment, there is one inner wellhead member load shoulder 31 and one outer wellhead member tag/load shoulder 15. The number of load shoulders 15, 31 can vary. An enlarged portion 33 of the inner wellhead member 29 directly above the load shoulder 31 has a diameter that is only slightly less than the inner diameter of the bore 13.

In the illustrated embodiment, a load ring 35 is mounted on the inner wellhead member 29 to support the inner wellhead member 29 on the outer wellhead member tag/load shoulder 15. In this embodiment, the upper surface of the load ring 35 is substantially geometrically complimentary to the load shoulder 31 of the inner wellhead member 29. An outer portion of the lower surface of the load ring 35 is conical and forms a generally downward facing load shoulder 37 that inclines relative to an axis of the bore 30 of the inner wellhead member 29. The generally downward facing load shoulder 37 is substantially geometrically complimentary to the upward facing shoulder 19 of the load ring 17. The load shoulder 37 of the load ring 35 is dimensioned to land on the load shoulder 19 of the load ring 17 in the outer wellhead member bore 13 (FIG. 1).

A centralizer/overpull assembly 41 is mounted to the inner wellhead member 29, below the load ring 35. In this embodiment, the centralizer/overpull assembly 41 comprises a retainer ring 43 and a centralizer/overpull ring 45 positioned within an annular recess 47 on the outer surface of the inner wellhead member 29. As illustrated in FIG. 1, the upper end of the retainer ring 43 is positioned in abutting contact with a portion of the lower surface of the load ring 35 and acts to maintain its position on the inner wellhead member 29. The lower end 49 of the retainer ring 43 is conical and declines at an angle relative to the axis of the bore 30 of the inner wellhead member 29. In this embodiment, the lower end 49 of the retainer ring 43 declines at an angle of thirty degrees relative to the axis of the bore 30 of the inner wellhead member 29. A select distance below the retainer ring 43, the diameter of the inner wellhead member 29 slightly decreases, thereby forming a generally downward facing shoulder 53. The diameter of the inner wellhead member 29 increases a select distance below the downward facing shoulder 53, thereby forming a generally upward facing shoulder 55. In this embodiment, the generally upward facing shoulder 55 inclines slightly upward at an angle relative to the axis of the bore 30 of the inner wellhead member 29.

Figure 3:
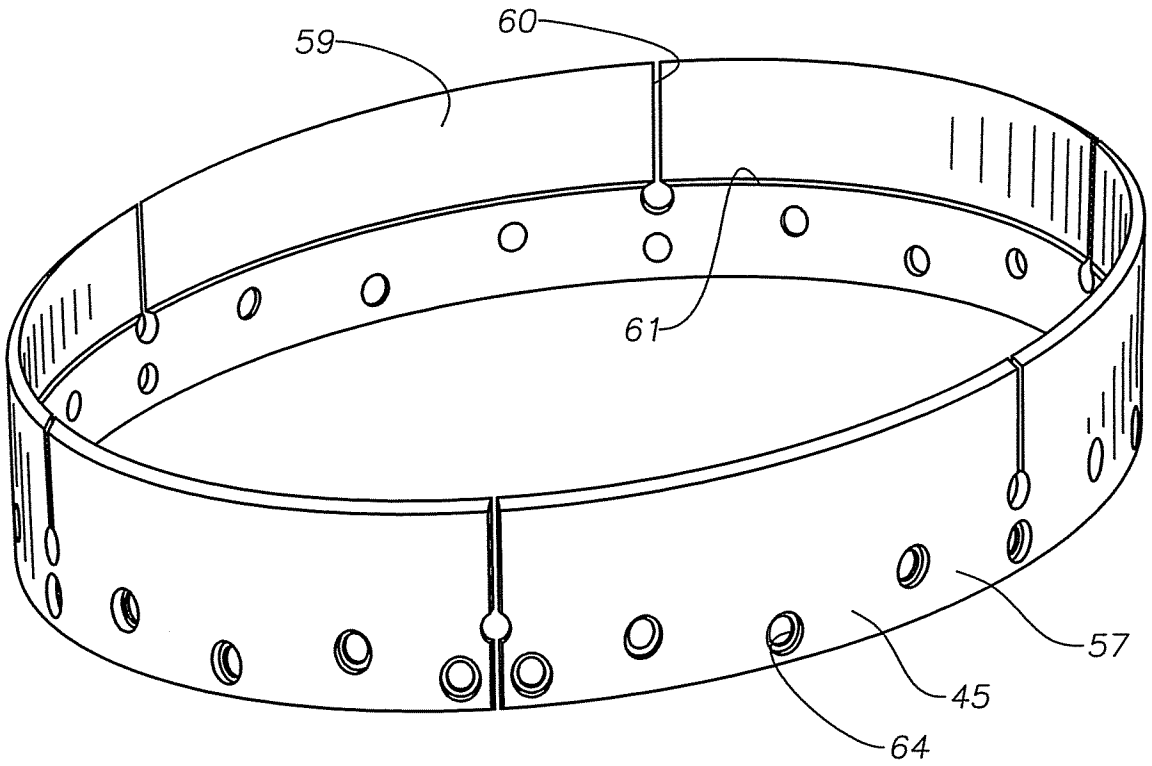
FIG. 3 is an isolated perspective view of the centralizer/overpull ring of FIG. 1.

As illustrated in FIG. 3, in this embodiment, the centralizer/overpull ring 45 is a split ring having an annular band 57 with a plurality of resilient finger members 59 extending upward and outwardly from the annular band 57 at an angle θ (FIG. 1) from the axis of the bore 30 of the inner wellhead member 29 to form a collet-like member. In this embodiment, there are six finger members 59 positioned around the diameter of the annular band 57, each finger 59 being separated from another by a slot 60. The diameter of the centralizer/overpull ring 45 decreases from the annular band 57 to the finger members 59, thereby forming a generally upward facing shoulder 61. The upward facing shoulder 61 is substantially geometrically complimentary to the downward facing shoulder 53 on the inner wellhead 29 (FIG. 1). As illustrated in FIG. 1, in this embodiment, the centralizer/overpull ring 45 is connected to the inner wellhead member 29 by a plurality of fasteners 63 that extend through a plurality of apertures 64 in the annular band 57 portion of the ring 45 and into the inner wellhead member 29. The upper ends 65 of the finger members 59 are conical and decline at angle relative to the axis of the bore 30 of the inner wellhead member. The upper ends 65 of the finger member 59 are substantially geometrically complimentary to the lower end 49 of the retainer ring 43. In this embodiment, the upper ends 65 of the finger members 59 decline at an angle of thirty degrees relative to the axis of the bore 30 of the inner wellhead member 29. The engagement between the angled lower end 49 of the retainer ring 43 and the upper ends 65 of the finger members 59 limits the degree to which the finger members 59 extend radially outward from the inner wellhead member 29 beyond the diameter of the enlarged portion 33 of the inner wellhead member 29. The upper ends 65 of the finger members 59 are also substantially geometrically complimentary to the generally downward facing overpull shoulder 25 in the recess 23 of the outer wellhead member 11. The lower end 67 of the annular band 57 portion of the centralizer/overpull ring 45 is inclined at an angle relative to the bore of the axis 30 of the inner wellhead member 29 and is substantially geometrically complimentary to the upward facing shoulder 55 in the inner wellhead member 29.

Figure 4:
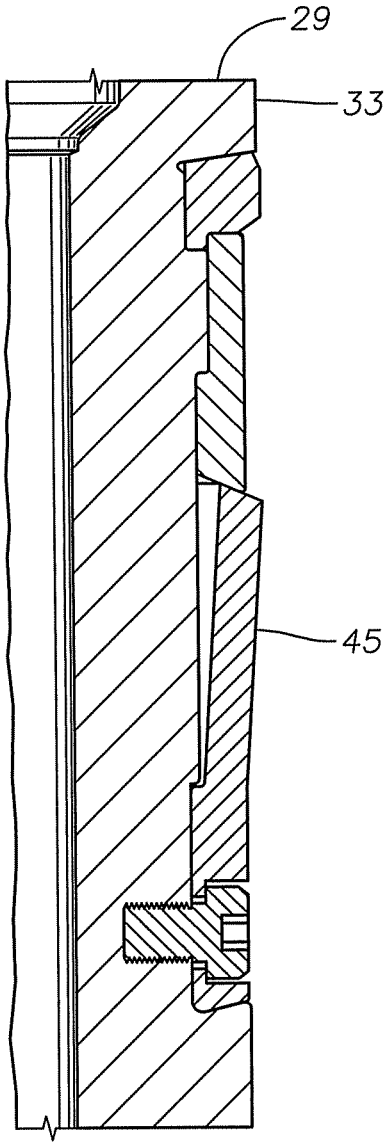
FIG. 4 is an isolated sectional view of the inner wellhead member, the load ring, and the centralizer/overpull assembly constructed in accordance with this technique.

As illustrated in FIG. 4, in the initial orientation of the inner wellhead member 29 prior to tripping the inner wellhead member 29 into the outer wellhead member 11 (FIG. 1), the centralizer/overpull ring 45 is fully expanded, with the outer diameter of centralizer/overpull ring 45 being greater than or equal to the outer diameter of the enlarged portion 33 of the inner wellhead member 29. In the expanded position, an outer portion of the lower end 49 of the retainer ring 43 abuttingly contacts an inner portion of the upper ends 65 of the finger members 59, thereby limiting the extent to which the finger members 59 extend radially outward from the inner wellhead member 29.

Figure 5:
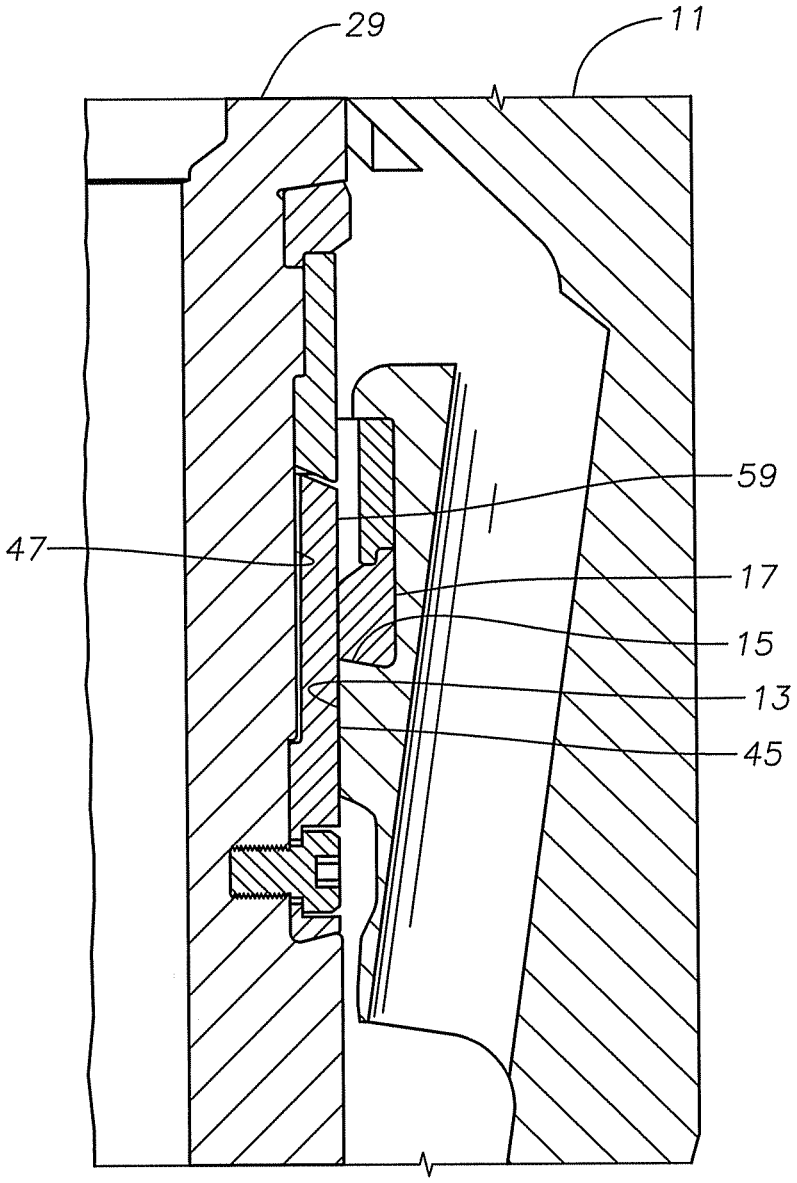
FIG. 5 is an isolated sectional view of the inner wellhead member of FIG. 4, shown in a landing position within the outer wellhead member.

As illustrated in FIG. 5, from the trip-in position (FIG. 4), in operation, as the inner wellhead member 29 is tripped into the well, the centralizer/overpull ring 45 makes contact with the surfaces of the bore 13 of the outer wellhead member 11 and is compressed into the annular recess 47 on the outer surface of the inner wellhead member 29 as the centralizer/overpull ring 45 centralizes the inner wellhead member 29 in the outer wellhead member 11. When the finger members 59 are in the fully compressed position within the recess 47, the upper ends 65 of the finger members 59 are not in abutting contact with the lower end 49 of the retainer ring 43, thereby resulting in a gap between them.

As the inner wellhead member 29 is further lowered into the bore 13, the finger members 59 of the centralizer/overpull ring 45 slidingly engage the load ring 17 carried by the outer wellhead member 11 and positioned on the tag/load shoulder 15 of the bore 13. The finger members 59 of the centralizer/overpull ring 45 contact the load ring 17, thereby pushing the finger members 59 radially inward into the recess 47, further compressing the fingers members 59, allowing the centralizer/overpull ring 45 to move below the load ring 17 and the tag/load shoulder 15.

As illustrated by FIG. 1, as the inner wellhead member 29 further enters the bore 13, the load ring 35 of the inner wellhead member 29, and in particular, the load shoulder 37 lands on the load shoulder 19 of the load ring 17 on the outer wellhead member tag/load shoulder 15. The inner wellhead member 29 moves downward relative to the outer wellhead member 11 until the load ring 35 of the inner wellhead member 29 is fully engaged with the load ring 17 of the outer wellhead member 11, and the inner wellhead member 29 is in a set position within the outer wellhead member 11. In addition, as the inner wellhead member 29 moves downward relative to the outer wellhead member 11, the centralizer/overpull assembly 41 moves downward with the inner wellhead member 29 until the centralizer/overpull ring 45 reaches the overpull recess 23. When the inner wellhead member 29 reaches the set position, the centralizer/overpull ring 45 simultaneously reaches the recess 23, the resilient finger members 59 of the centralizer/overpull ring 45 expand radially outward and into the overpull recess 23, thereby moving the centralizer/overpull assembly 41 to an expanded position.

Once fully engaged, the generally downward facing load shoulder 37 of the load ring 35 of the inner wellhead member 29 is in contact with the generally upward facing load shoulder 19 of the load ring 17 of the outer wellhead member 11. A downward load on the inner wellhead member 29 transfers from the inner wellhead member load shoulder 31 through the load ring 35, the load ring 17, and into the outer wellhead member tag/load shoulder 15.

A reduction in the weight of the running string is an indication that the inner wellhead member 29 has properly set within the outer wellhead member 11. As a further assurance, the operator can apply a selected overpull. An overpull is a test where a lifting force is applied by the running string to the inner wellhead member 29. When in the set position, the upper ends 65 of the finger members 59 of the centralizer/overpull ring 45 rest within the recess 23 on the outer wellhead member 11.

Figure 6:
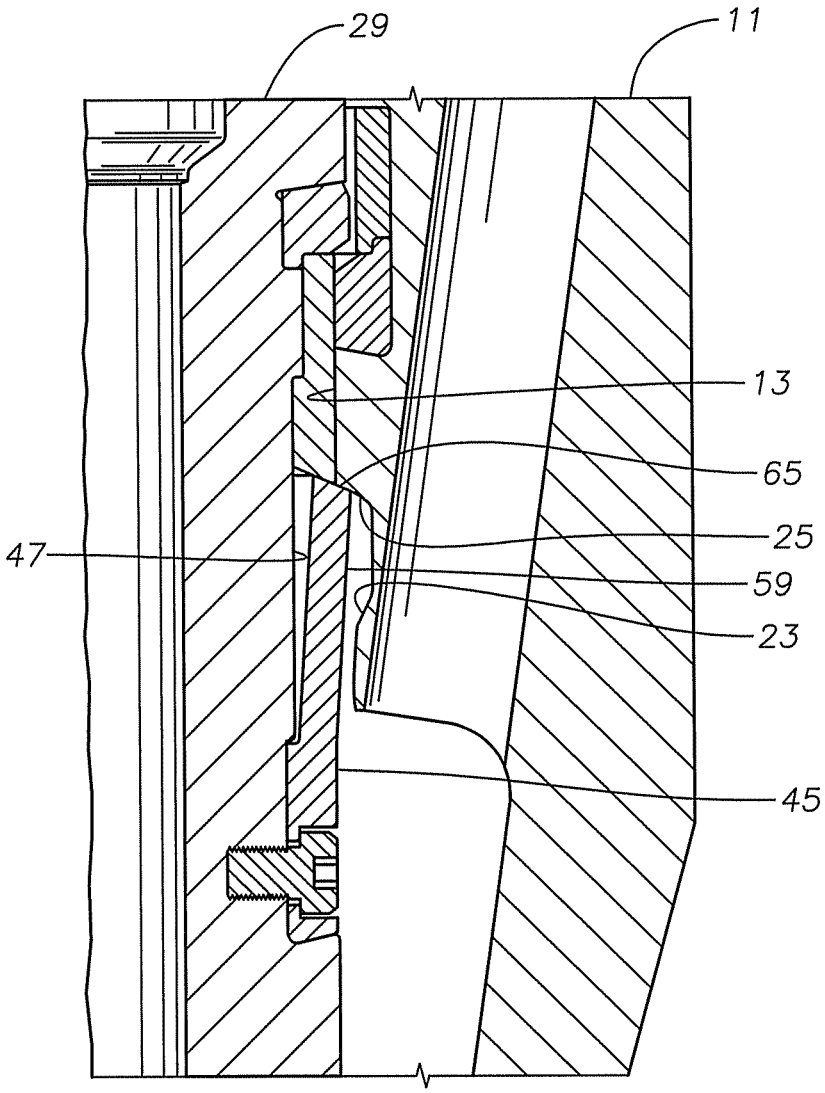
FIG. 6 is an isolated sectional view of the inner wellhead member of FIG. 4, shown in an overpull position within the outer wellhead member.

As illustrated by FIG. 6, and as previously discussed, the upper ends 65 of the finger members 59 of the centralizer/overpull ring 45 are geometrically complimentary to the generally downward facing shoulder 25 of the recess 23. In order to perform an overpull to determine if the inner wellhead member 29 is properly positioned in the set position within the bore 13 of the outer wellhead member 11, an upward force is applied to the inner wellhead member 29. The inner wellhead member 29 initially moves upward relative to the outer wellhead member 11 until the upper ends 65 of the finger members 59 of the centralizer/overpull ring 45 abut against the generally downward facing overpull shoulder 25 of the recess 23. A defined overpull force, for example, 120,000 pounds, is necessary to move the finger members 59 of the centralizer/overpull ring 45 radially inward into the recess 47 on the inner wellhead member 29, thereby moving the centralizer/overpull ring 45 to a retracted position. Therefore, the operator will pull upward a fraction of that amount, for example, 60,000 pounds, to determine if the angled upper ends 65 of the finger members 59 of the centralizer/overpull ring 45 are abuttingly contacting the generally downward facing overpull shoulder 25 of the recess 23. If the pull upward does not result in further upward movement of the inner wellhead member 29, this indicates that the centralizer/overpull ring 45 is located correctly and, therefore, the inner wellhead member 29 is located correctly within the outer wellhead member 11 and has properly set. The operator can then slack off the weight.

The centralizer/overpull assembly 41 of the present technique may also be incorporated on an inner wellhead member with a load ring and an activation ring to prevent the load ring from prematurely activating. Non-stationary load rings and activation rings that may be incorporated with the present technique are known in the art. For example, the centralizer/overpull assembly 41 of the present technique could be incorporated with a hanger such as that disclosed in U.S. Pat. No. 7,380,607, herein incorporated by reference in its entirety. In such an embodiment, the centralizer/overpull assembly 41 would extend radially outward from the inner wellhead member to prevent side loading of the load ring or activation ring and premature activation of the load ring.

The centralizer/overpull assembly 41 of the present technique may also be incorporated on an inner wellhead member that does not include a load ring or a load shoulder. For example, the centralizer/overpull assembly 41 of the present technique may be incorporated on an inner wellhead member that does not have a load ring or a load shoulder, and the centralizer/overpull assembly 41 may be used to perform and overpull test to indicate that the inner wellhead member is properly positioned within an outer wellhead member.

The technique has significant advantages. The centralizer/overpull assembly acts as an indicator to an operator that the inner wellhead member is properly positioned within the outer wellhead member. Additionally, the centralizer/overpull assembly acts as a centralizer to prevent side loading and premature activation of a load ring to ensure that a load ring is properly set.

In the drawings and specification, there have been disclosed a typical preferred embodiment of the technique, and although specific terms are employed, the terms are used in a descriptive sense only and not for purposes of limitation. The technique has been described in considerable detail with specific reference to these illustrated embodiments. It will be apparent, however, that various modifications and changes can be made within the spirit and scope of the technique as described in the foregoing specification and as set forth in the following claims.

The invention claimed is:

1. A wellhead assembly comprising:

an outer wellhead member having a bore defining a longitudinal axis, the bore having a first profile portion and an annular recess;

a tubular inner wellhead member adapted to be lowered into the bore of the outer wellhead member; and a centralizer/overpull ring positioned on the inner wellhead member, the centralizer/overpull ring having a lower band portion and a plurality of resilient finger members extending upwardly therefrom, the plurality of resilient finger members each being separated from one another by a longitudinal slot extending from the lower band portion to upper ends of the plurality of resilient finger members, and the plurality of resilient finger members each being biased to expand outward with respect to the lower band portion to engage the bore of the outer wellhead member to center the inner wellhead member within the bore as the inner wellhead member is lowered through the bore, wherein the recess of the outer wellhead member is adapted to receive the plurality of resilient finger members and oppose axial movement of the centralizer/overpull ring to enable an upward test pull of the inner wellhead member.

2. The wellhead assembly of claim 1, wherein the wellhead assembly further comprises:

the upper ends of the plurality of resilient finger members having a conical taper and the recess having a conical taper that is substantially geometrically complimentary to the conical taper of the upper end of the plurality of resilient finger members, the conical tapers abuttingly contacting one another in an overpull position.

3. The wellhead assembly of claim 2, wherein the wellhead assembly further comprises:

a retainer ring positioned on the inner wellhead member above the centralizer/overpull ring, the lower end of the retainer ring having a conical taper that is substantially geometrically complimentary to the conical taper of the upper ends of the plurality of resilient finger members such that the retainer ring limits the extent to which the plurality of resilient finger members extend radially outward from the inner wellhead member.

4. The wellhead assembly of claim 3, wherein the conical taper of the upper ends of the plurality of resilient members and the conical taper of the recess are angled between 30 degrees and 60 degrees relative to the longitudinal axis of the bore of the outer wellhead member.

5. The wellhead assembly of claim 1, wherein the wellhead assembly further comprises:

the upper ends of the plurality of resilient finger members having a cylindrical taper and the recess having a cylindrical taper that is substantially geometrically complimentary to the cylindrical taper of the upper ends of the plurality of resilient finger members, the cylindrical tapers abuttingly contacting one another in an overpull position.

6. The wellhead assembly of claim 5, wherein the wellhead assembly further comprises:

a retainer ring positioned on the inner wellhead member above the centralizer/overpull ring, the lower end of the retainer ring having a cylindrical taper that is substantially geometrically complimentary to the cylindrical taper of the upper ends of the plurality of resilient finger members such that the retainer ring limits the extent to which the plurality of resilient finger members extend radially outward from the inner wellhead member.

7. The wellhead assembly of claim 6, wherein the cylindrical taper of the upper ends of the plurality of resilient finger members and the cylindrical taper of the recess are angled between 30 degrees and 60 degrees relative to the longitudinal axis of the bore of the outer wellhead member.

8. The wellhead assembly of claim 1, wherein the centralizer/overpull fixed axially relative to the inner wellhead member.

9. The wellhead assembly of claim 1, wherein the centralizer/overpull ring is carried in a cavity on inner wellhead member and has an outer diameter greater than the inner diameter of the first profile portion, but retracts inward into the cavity when moving past the first profile portion.

10. A wellhead assembly comprising:

an outer wellhead member having a bore defining a longitudinal axis, the bore having a first profile portion and an annular recess;

a tubular inner wellhead member adapted to be lowered into the bore of the outer wellhead member;

a centralizer/overpull ring positioned on the inner wellhead member, the centralizer/overpull ring comprising a lower band portion and a plurality of resilient finger members extending upwardly therefrom, the plurality of resilient finger members each being separated from one another by a longitudinal slot extending from the lower band portion to upper ends of the plurality of resilient finger members, and the plurality of resilient finger members each being biased to expand outward with respect to the lower band portion to engage the bore of the outer wellhead member to center the inner wellhead member within the bore as the inner wellhead member is lowered through the bore, wherein the recess of the outer wellhead member is adapted to receive the plurality of resilient finger members and oppose axial movement of the centralizer/overpull ring to enable an upward test pull of the inner wellhead member; and a retainer ring positioned on the inner wellhead member above the centralizer/overpull ring and adapted to limit the extent to which the plurality of resilient finger members extend radially outward from the inner wellhead member.

11. The wellhead assembly of claim 10, wherein the wellhead assembly further comprises:

the upper ends of the plurality of resilient finger members having a conical taper and the recess having a conical taper that is substantially geometrically complimentary to the conical taper of the upper ends of the plurality of resilient finger members, the conical tapers abuttingly contacting one another in an overpull position.

12. The wellhead assembly of claim 11, wherein the retainer ring has a conical taper that is substantially geometrically complimentary to the conical taper of the upper ends of the plurality of resilient finger members such that a portion of the conical taper of the retainer ring abuttingly contacts a portion of the conical taper of the upper ends of the plurality of resilient finger members when the plurality of resilient finger members are fully extended radially outward.

13. The wellhead assembly of claim 12, wherein the conical taper of the upper ends of the plurality of resilient finger members and the conical taper of the recess are angled at between 30 degrees and 60 degrees relative to the longitudinal axis of the bore of the outer wellhead member.

14. The wellhead assembly of claim 13, wherein the centralizer/overpull ring is fixed axially relative to the inner wellhead member.

15. The wellhead assembly of claim 14, wherein the centralizer/overpull ring is carried in a cavity on inner wellhead member and has an outer diameter greater than the inner diameter of the first profile portion, but retracts inward into the cavity when moving past the first profile portion.

16. A method of assembling a wellhead assembly, the method comprising:

providing an outer wellhead member having a bore, the bore having a first profile portion and an annular recess; a tubular inner wellhead member; and a resilient retractable and expandable centralizer/overpull ring positioned on the inner wellhead member, wherein the centralizer/overpull ring comprises a lower band portion and a plurality of resilient finger members extending upwardly therefrom;

lowering the inner wellhead member into the outer wellhead member with the centralizer/overpull ring in an expanded run-in position;

retracting the centralizer/overpull ring into a recess on the inner wellhead member due to contact of the centralizer/overpull ring with the bore as the inner wellhead member is lowered into the outer wellhead member;

when the inner wellhead member has reached a desired position within the outer wellhead member, expanding the centralizer/overpull ring into the recess of the outer wellhead member;

applying an upward force on the inner wellhead member once the inner wellhead member is properly positioned within the outer wellhead member to engage the centralizer/overpull ring with the recess of the outer wellhead member thereby engaging the plurality of resilient finger members with the recess of the outer wellhead member; and verifying an opposition to upward axial movement of the inner wellhead member due to the engagement of the centralizer/overpull ring with the recess of the outer wellhead member, thereby indicating proper location of the inner wellhead member.

17. The method of claim 16, wherein the centralizer/overpull ring further comprises a conical taper on the upper ends of the plurality of resilient finger members; and wherein the recess comprises a conical taper, substantially geometrically complimentary to the conical taper of the upper ends of the plurality of resilient finger members; and the method further comprises:

abuttingly engaging the conical taper of the upper ends of the plurality of resilient members and the conical taper of the recess abuttingly contact one another when the upward force is applied to the inner wellhead member when the inner wellhead member is properly positioned within the outer wellhead member.

18. The method of claim 16, further comprising:

providing a retainer ring on the inner wellhead member above the centralizer/overpull ring; and engaging the retainer ring with the centralizer/overpull ring to limit to extent to which the centralizer/overpull ring is radially expandable outwardly from the inner wellhead member.

19. The method of claim 16, further comprising:

providing a load ring on the inner wellhead member above the centralizer/overpull ring; and engaging the load ring with the first profile portion of the inner wellhead member simultaneously with expanding the centralizer/overpull ring into the recess of the outer wellhead member.

* * * * *